US005327867A

United States Patent [19]

Hisaki et al.

[11] Patent Number: 5,327,867

[45] Date of Patent: Jul. 12, 1994

[54] MISFIRE-DETECTING SYSTEM FOR INTERNAL COMBUSTION ENGINES

[75] Inventors: Takashi Hisaki; Yuichi Shimasaki; Shigeki Baba; Masaki Kanehiro; Takuji Ishioka; Shigeru Maruyama; Kazuhito Kakimoto; Masataka Chikamatsu; Shukoh Terata; Kenichi Maeda, all of Wako, Japan

[73] Assignee: Honda Giken Kogyo Kabushiki Kaisha, Tokyo, Japan

[21] Appl. No.: 26,055

[22] Filed: Mar. 3, 1993

[30] Foreign Application Priority Data

Mar. 13, 1992 [JP] Japan ..... 4-089400

[51] Int. Cl.[5] ..... F02P 5/00

[52] U.S. Cl. ..... 123/406; 123/630

[58] Field of Search ..... 123/406, 643, 630, 425; 324/380, 399

[56] References Cited

U.S. PATENT DOCUMENTS

| | | | |
|---|---|---|---|
| 4,112,351 | 9/1978 | Back et al. | 324/380 |
| 4,449,100 | 5/1984 | Johnson et al. | 324/380 |
| 4,689,573 | 8/1987 | Hilmer | 324/380 |
| 4,862,093 | 8/1989 | Jiewertz | 123/425 |
| 4,918,389 | 4/1990 | Schluepen et al. | 324/399 |
| 5,065,729 | 11/1991 | Krauter et al. | 123/643 |
| 5,111,790 | 5/1992 | Grandy | 123/425 |
| 5,215,067 | 6/1993 | Shimasaki et al. | 324/399 |
| 5,237,279 | 8/1993 | Shimasaki et al. | 324/399 |

*Primary Examiner*—Raymond A. Nelli

*Attorney, Agent, or Firm*—Nikaido, Marmelstein, Murray & Oram

[57] ABSTRACT

A misfire-detecting system for an internal combustion engine carries out self-diagnosis of the system. In the system, sparking voltage generated across a spark plug of a cylinder of the engine is detected, and the detected sparking voltage is compared with a first predetermined reference voltage value, and a time period is measured over which the detected sparking voltage exceeds the first predetermined reference voltage value. It is determined that a misfire occurred in the engine when the measured time period exceeds a predetermined time period value. It is determined whether the engine is in self-sustaining operation. When it is determined that the engine is in self-sustaining operation, it is determined whether the misfire-detecting system is abnormal. It is determined that the misfire-detecting system is abnormal when the detected sparking voltage is lower than a second reference voltage value. Alternatively or in combination, it is determined that the misfire-detecting system is abnormal when the detected sparking voltage has continued to be higher than a third predetermined reference voltage value over a predetermined time period.

12 Claims, 8 Drawing Sheets

A
t0
B'
V
VCOMP
C'

C
B
t0
t2 t3
t5
D'

D
t1 t2
t4
t5
E'
CP
CPREF

E
t0
t1 t2
t4
t6

FMIS
1
0
t0
t6

MISFIRE-DETECTING SYSTEM FOR INTERNAL COMBUSTION ENGINES

BACKGROUND OF THE INVENTION

1. Field of the Invention

This invention relates to a misfire-detecting system for internal combustion engines, and more particularly to a misfire-detecting system of this kind, which is equipped with a device for detecting abnormality thereof.

2. Prior Art

A spark plug of an internal combustion engine can suffer from abnormal ignition or misfires. The misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by so-called mis-sparking, which means that normal spark discharge does not take place at the spark plug. Mis-sparking occurs e.g. due to smoking or wetting of the spark plug with fuel, particularly adhesion of carbon in the fuel to the spark plug, which causes current leakage between the electrodes of the spark plug, or due to abnormality in the sparking voltage-supplying system.

The present assignee has already proposed a misfire-detecting system for detecting misfires attributable to the fuel supply system, which comprises sparking voltage-detecting means for detecting sparking voltage across electrodes of a spark plug, and misfire-determining means which determines that a misfire has occurred when a time period over which the detected value of the sparking voltage exceeds a predetermined voltage value exceeds a predetermined time period (Japanese Patent Application No. 3-326507).

However, the above proposed system is incapable of detecting abnormality in the system, such as a fault in a sensor for detecting the sparking voltage, or a disconnection or a ground-fault (short-circuit to ground) in wiring between the sensor and an electronic control unit for executing the misfire determination.

SUMMARY OF THE INVENTION

It is the object of the invention to provide a misfire-detecting system for an internal combustion engine, which is capable of detecting abnormality in the system, such as a fault in a sparking voltage sensor.

To attain the object, the invention provides a misfire-detecting system for an internal combustion engine having at least one cylinder, and a spark plug provided in each of the at least one cylinder, the system including engine operating condition-detecting means for detecting values of operating parameters of the engine, signal-generating means for determining ignition timing of the engine, based upon values of operating parameters of the engine detected by the engine operating condition-detecting means and for generating an ignition command signal indicative of the determined ignition timing, igniting means responsive to the ignition command signal for generating high voltage for causing generation of sparking voltage across the spark plug for discharging the spark plug, voltage value-detecting means for detecting a value of the sparking voltage generated across the spark plug when the high voltage is generated by the igniting means, comparing means for comparing the detected value of the sparking voltage with a first predetermined reference voltage value, measuring means for measuring a time period over which the detected value of the sparking voltage exceeds the first predetermined reference voltage value, and misfire-determining means for determining that a misfire has occurred in the engine when the measured time period exceeds a predetermined time period value.

The misfire-detecting system according to the invention is characterized by comprising:

engine operating condition-determining means for determining whether the engine is in self-sustaining operation; and abnormality-determining means for determining whether the misfire-detecting system is abnormal when it is determined by the engine operating condition-determining means that the engine is in self-sustaining operation.

Preferably, the abnormality-determining means determines that the misfire-detecting system is abnormal when the detected value of the sparking voltage is lower than a second predetermined reference voltage value while it is determined that the engine is in self-sustaining operation.

More preferably, the second predetermined reference voltage value is set to a value lower than the first predetermined reference voltage value.

Further preferably, the abnormality-determining means finally determines that the misfire-detecting system is abnormal when the misfire-detecting system is continuously determined to be abnormal over a predetermined time period.

More preferably, the misfire-detecting system includes a connection line connecting between the voltage-detecting means and the comparing means, and the abnormality-determining means determines abnormality in the voltage-detecting means and the connection line.

Preferably, the abnormality-determining means determines that the misfire-detecting system is abnormal when the detected value of the sparking voltage has continued to be higher than a third predetermined reference voltage value over a predetermined time period while it is determined that the engine is in self-sustaining operation.

More preferably, the misfire-detecting system includes a voltage-detecting section for detecting the sparking voltage, a misfire-determining section for determining whether a misfire has occurred in the engine, based upon the detected sparking voltage, and a connection line connecting between the voltage-detecting section and the misfire-determining section, and wherein the abnormality-determining means determines abnormality in the connection line.

Preferably, the engine operating condition-determining means determines that the engine is in self-sustaining operation, when at least one of a condition that the engine is rotating and at the same time the transmission transmitting the torque from the engine is in a neutral position, and a condition that the engine is idling, is satisfied.

The above and other objects, features, and advantages of the invention will become more apparent from the ensuing detailed description taken in conjunction with the accompanying drawings.

BRIEF DESCRIPTION OF THE DRAWINGS

FIG. 3*a* to FIG. 3*e* form together a timing chart which is useful in explaining the operation of the circuit arrangement of FIG. 1, in which:

FIG. 3*a* shows an ignition command signal A;

FIG. 3*b* shows sparking voltage and a comparative voltage level VCOMP;

FIG. 3*c* shows an output from a comparator;

Fig, 3*d* shows a count value CP of a counter; and

Figures 3A, 3B, 3C, 3D, 3E:
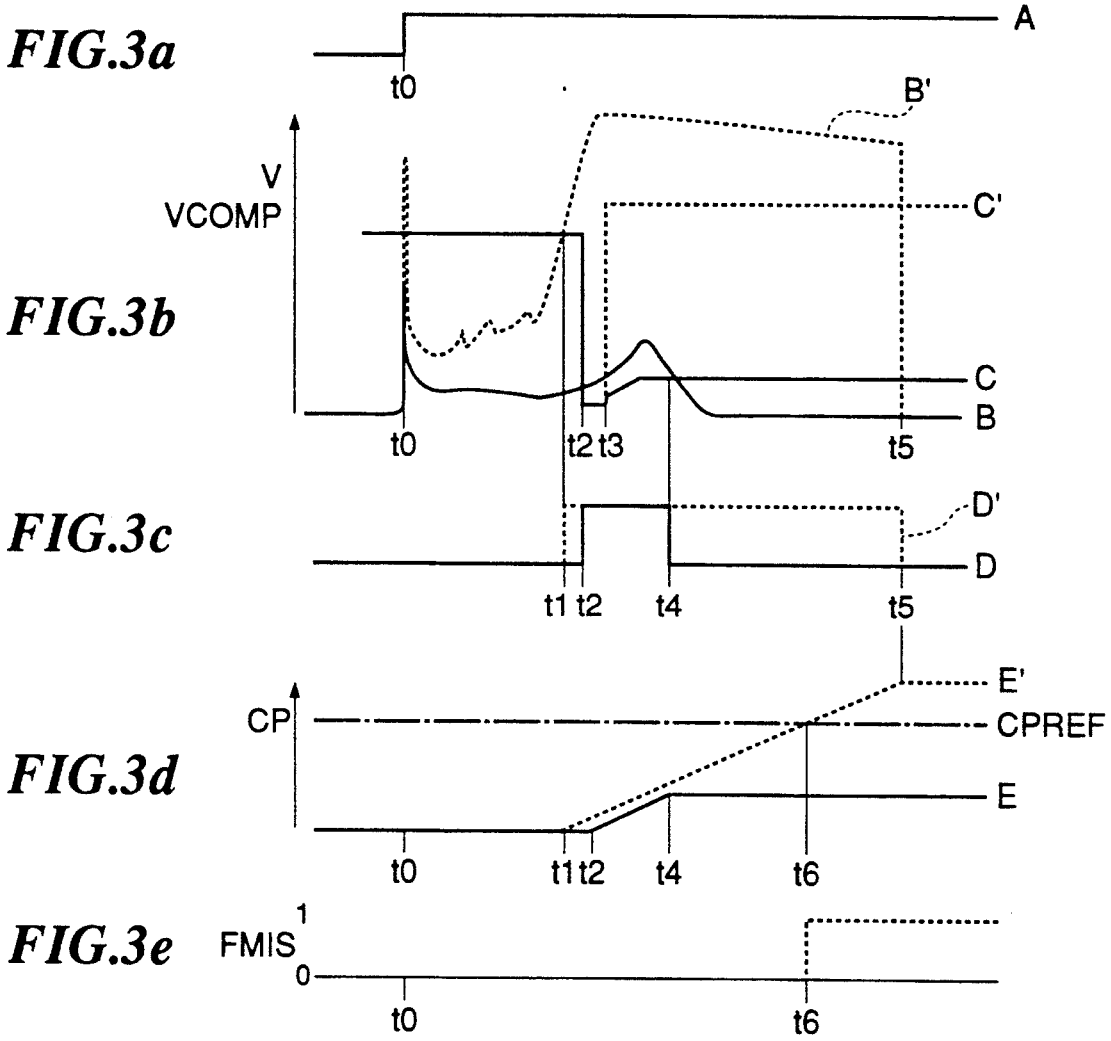
Figure 4:
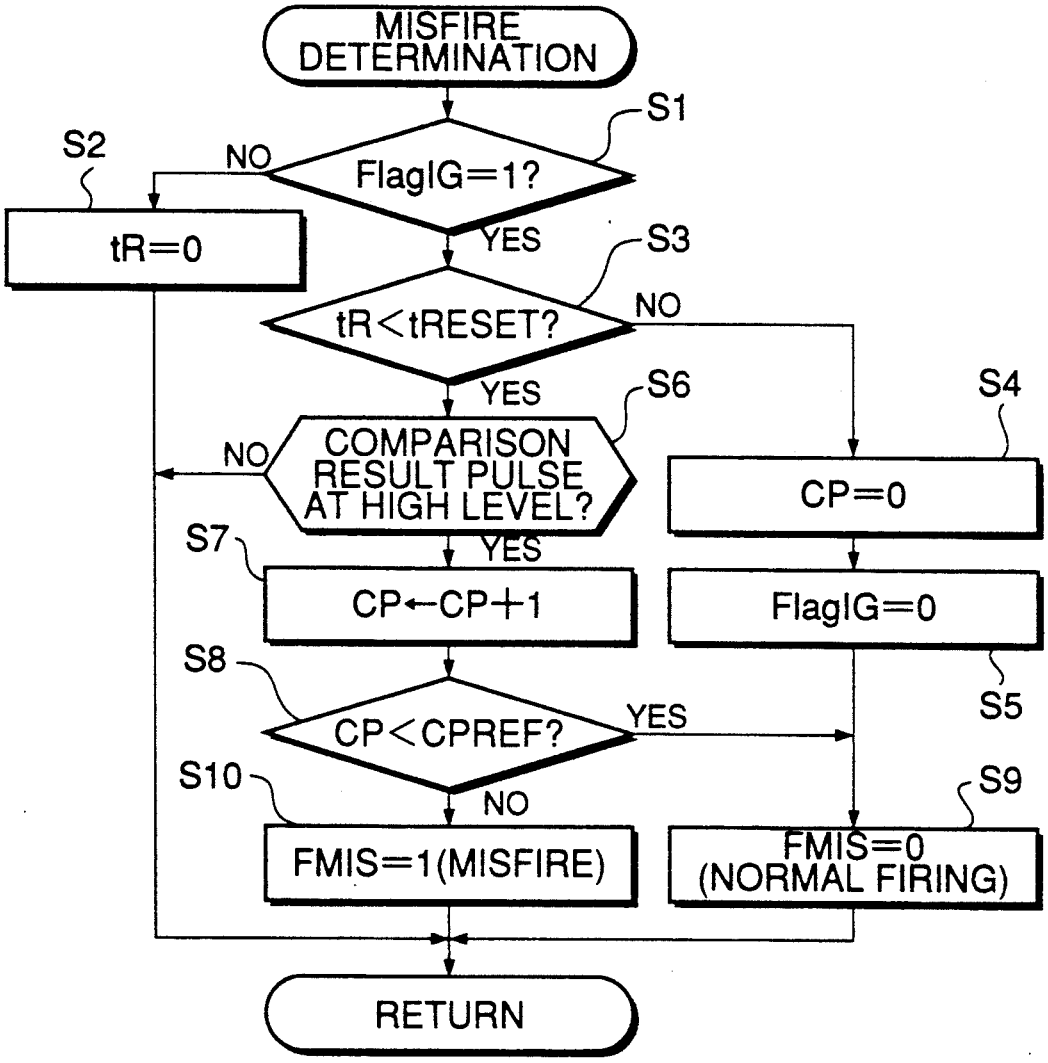
Figure 5:
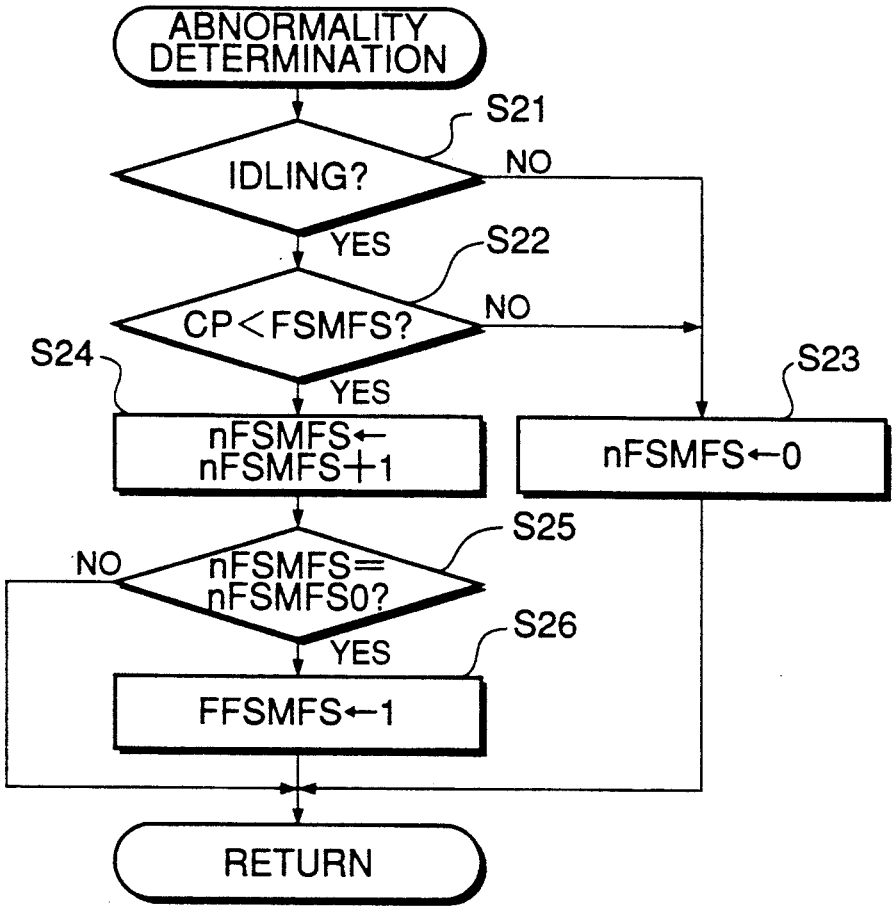
Figure 6:
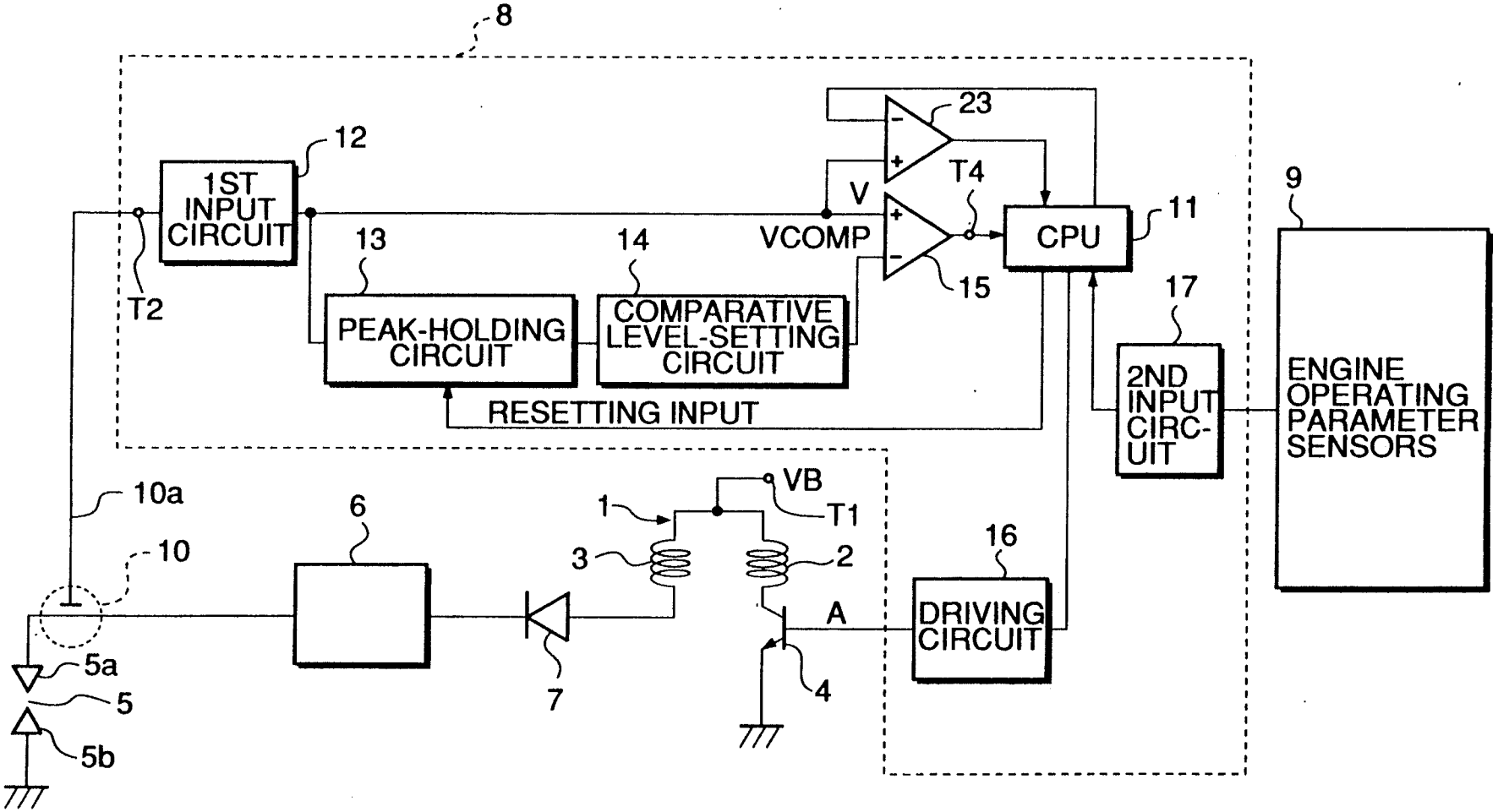
Figure 7:
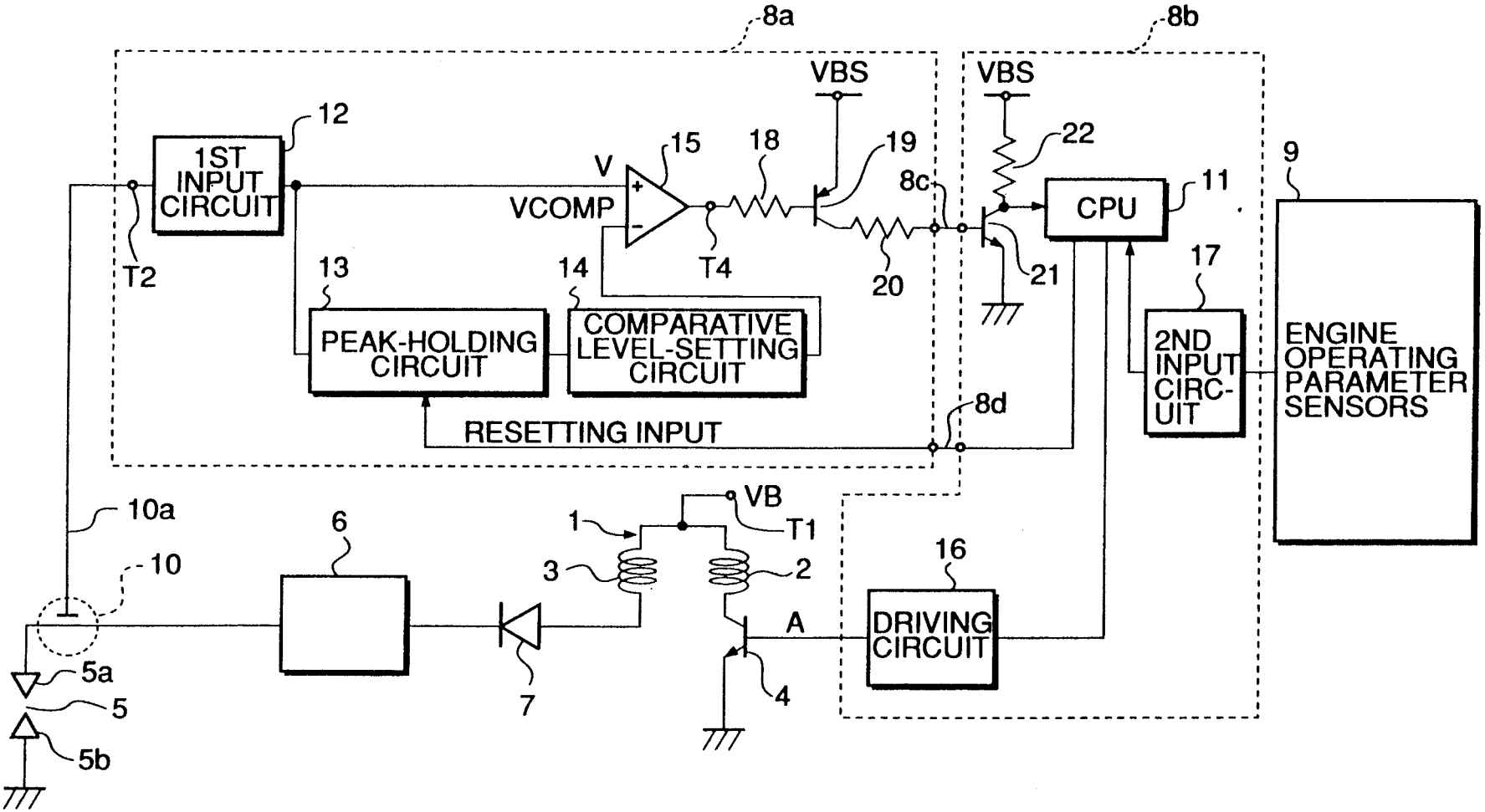
Figure 8:
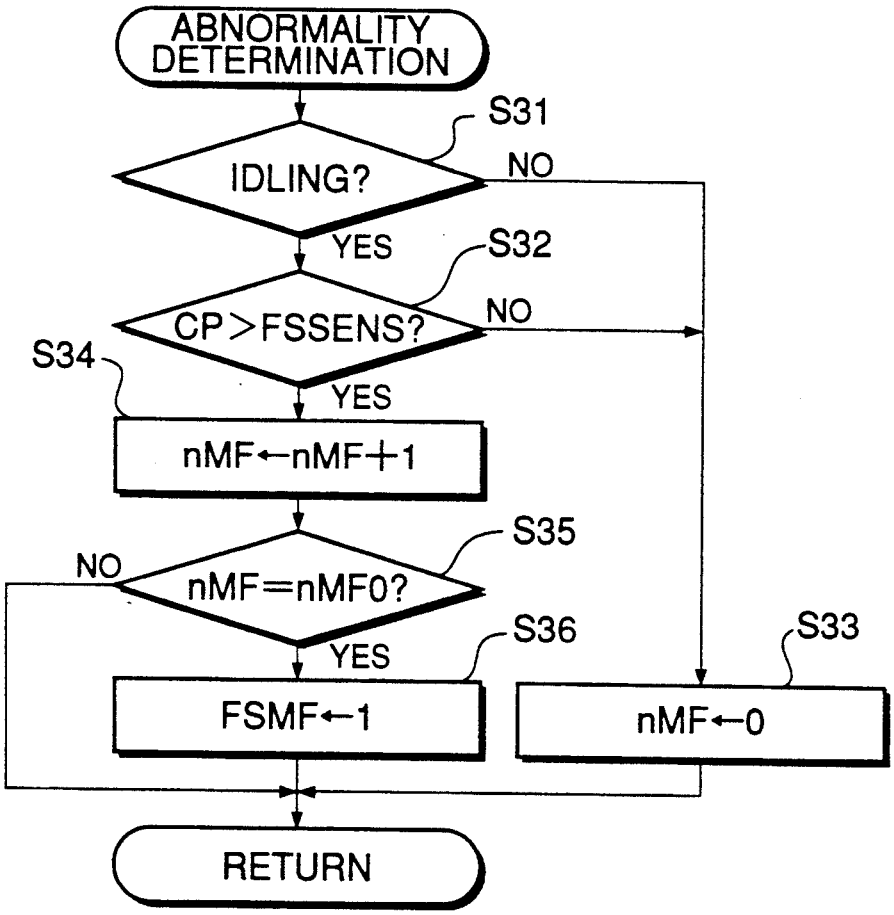

FIG. 3*e* shows a misfire detection flag FMIS;

FIG. 4 is a flowchart showing a program for determination of occurrence of a misfire, executed by the misfire-detecting system according to the first embodiment;

FIG. 5 is a flowchart showing a program for determining whether or not the misfire detecting system is abnormal, which is executed by the misfire-detecting system according to the first embodiment;

FIG. 6 is a schematic circuit diagram showing the circuit arrangement of a misfiring-detecting system according to a second embodiment of the invention;

FIG. 7 is a schematic circuit diagram showing the circuit arrangement of a misfiring-detecting system according to a third embodiment of the invention; and FIG. 8 is a flowchart showing a program for determining whether or not the misfire detecting system is abnormal, which is carried out by the misfire-detecting system according to the third embodiment.

DETAILED DESCRIPTION

The invention will now be described in detail with reference to the drawings showing embodiments thereof.

Figure 1:
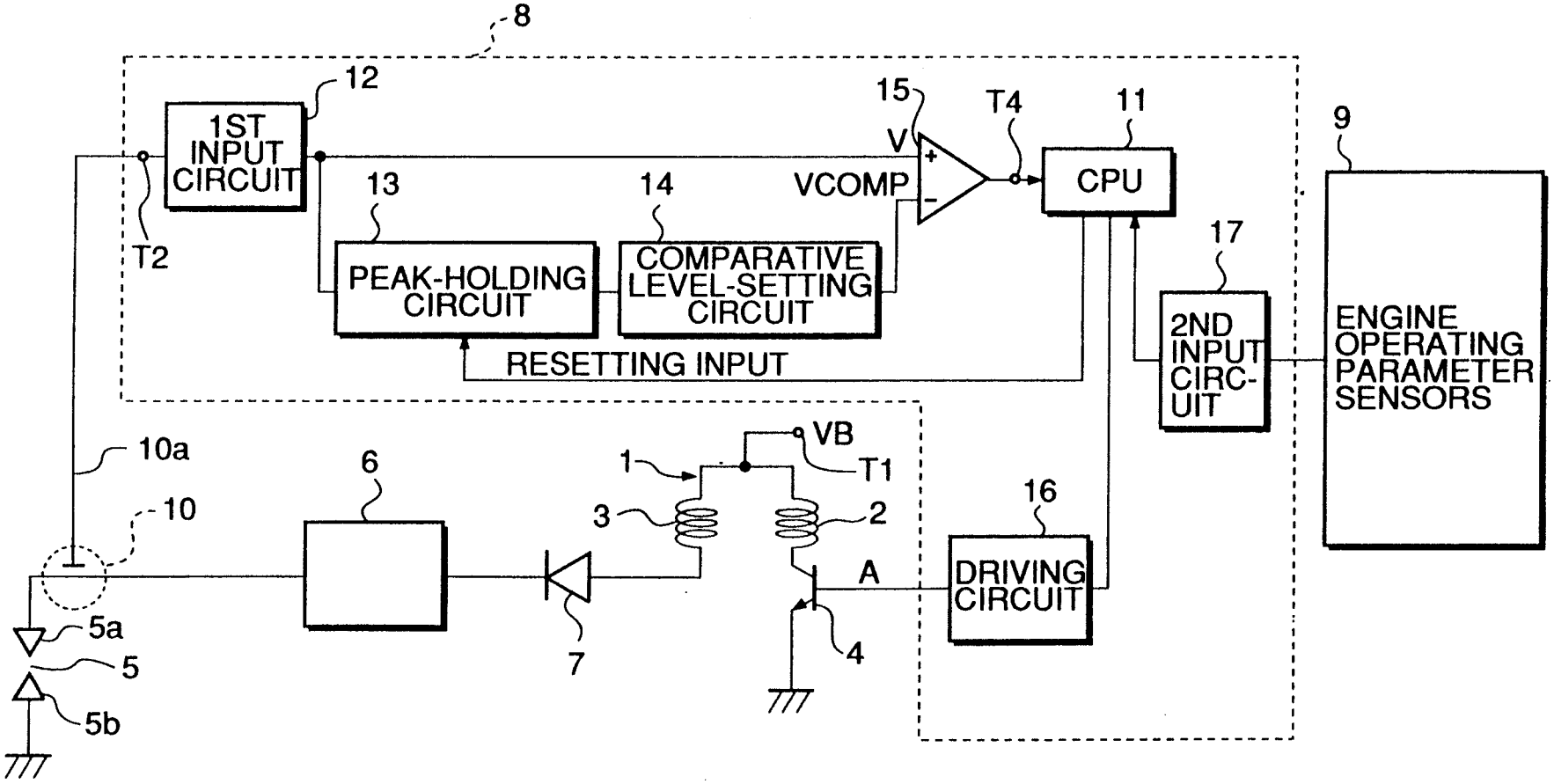
FIG. 1 is a schematic circuit diagram showing the circuit arrangement of a misfiring-detecting system according to a first embodiment of the invention.

Referring first to FIG. 1, there is shown the circuit arrangement of a misfire-detecting system according to a first embodiment of the invention. A feeding terminal T1, which is supplied with supply voltage VB, is connected to an ignition coil 1 comprised of a primary coil 2 and a secondary coil 3. The primary and secondary coils 2, 3 are connected with each other at ends thereof. The other end of the primary coil 2 is connected to a collector of a transistor 4. The transistor 4 has its base connected via a driving circuit 16 to a central processing unit (hereinafter referred to as "the CPU") 11 and its emitter grounded. The base of the transistor 4 is supplied with an ignition command signal A from the CPU 11. The other end of the secondary coil 3 is connected to an anode of a diode 7, which has its cathode connected via a distributor 6 to a center electrode 5*a* of a spark plug 5. The spark plug 5 has its grounding electrode 5*b* grounded.

Provided at an intermediate portion of a connection line connecting between the distributor 6 and the spark plug 5 is a sparking voltage sensor 10 which is electrostatically coupled to the connection line to form a capacitor having a capacitance of several pF's together with the connection line. The sparking voltage sensor 10 is connected to a first input circuit 12 via a connection line 10*a*. The first input circuit 12 is connected to a peak-holding circuit 13 and a non-inverting input terminal of a comparator 15. The output of the peak-holding circuit 13 is connected via a comparative level-setting circuit 14 to an inverting input terminal of the comparator 15. A resetting input terminal of the peak-holding circuit 13 is connected to the CPU 11 to be supplied with a resetting signal therefrom at an appropriate time for resetting a peak value of the sparking voltage held by the peak-holding circuit 13. An output from the comparator 15 is supplied to the CPU 11.

Connected via a second input circuit 17 to the CPU 11 are various engine operating parameter sensors 9 for detecting respective operating parameters of the engine, including the engine rotational speed NE, load on the engine such as the intake pipe absolute pressure PBA, the engine coolant temperature TW, and the engine lubricant oil temperature, for supplying the CPU 11 with the detected operating parameter values. Further connected to the CPU 11 via the driving circuit 16 is the base of the transistor 4 to supply the ignition command signal A thereto.

Figure 2:
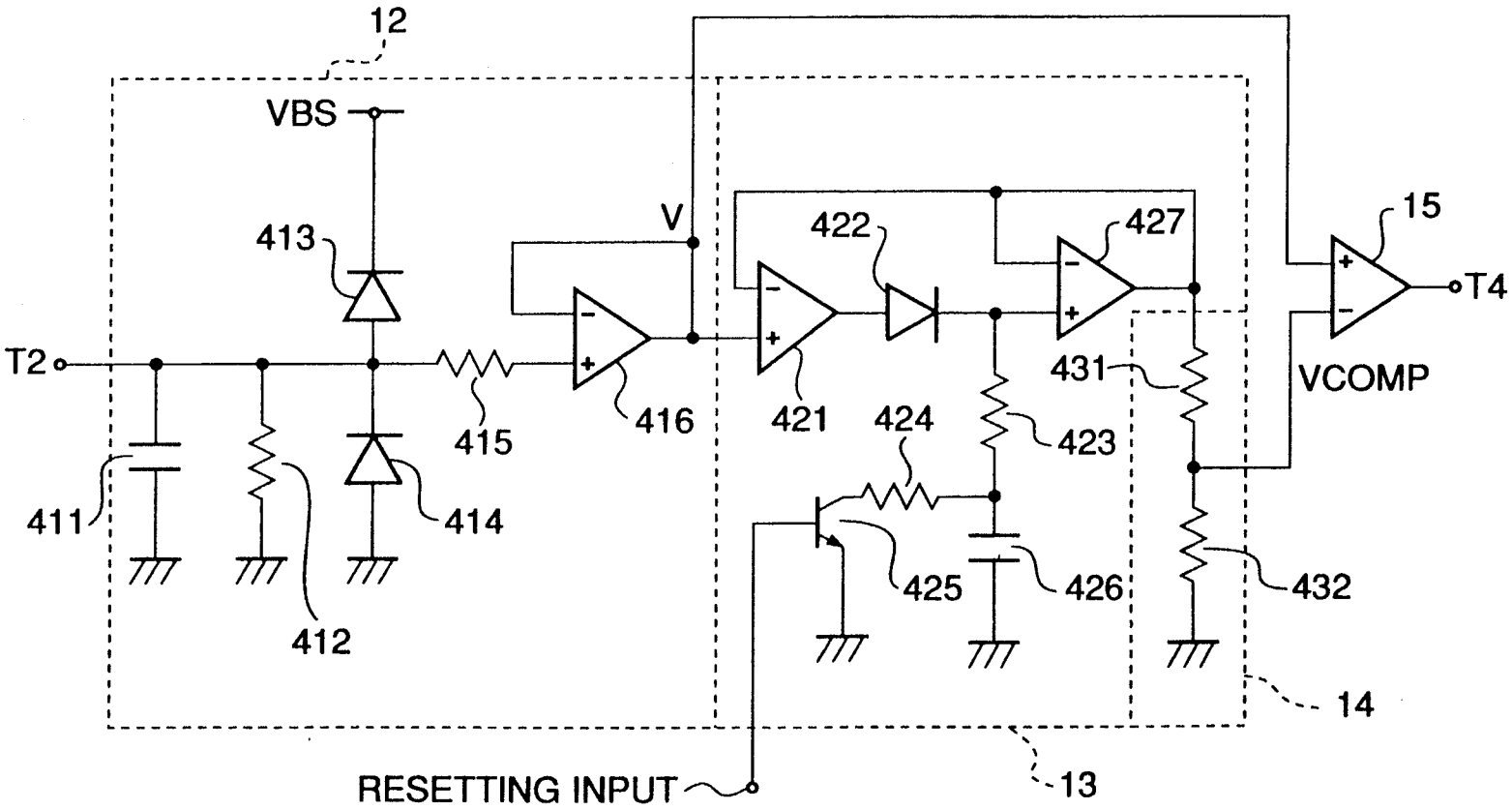
FIG. 2 is a circuit diagram showing details of a first input circuit, a peak-holding circuit, and a comparative level-setting circuit, all appearing in FIG. 1.

FIG. 2 shows details of the first input circuit 12, the peak-holding circuit 13 and the comparative level-setting circuit 14. As shown in the figure, an input terminal T2 is connected to a non-inverting input terminal of an operational amplifier 416 via a resistance 415. The input terminal T2 is also grounded via a circuit formed of a capacitor 411, a resistance 412, and a diode 414, which are connected in parallel, and connected to a supply voltage-feeding line VBS via a diode 413.

The capacitor 411 has a capacitance of $10^4$pF, for example, and serves to divide voltage detected by the sparking voltage sensor 17 into one over several thousands. The resistance 412 has a value of 500 KΩ, for example. The diodes 413 and 414 act to control the input voltage to the operational amplifier 416 to a range of 0 to VBS. An inverting input terminal of the operational amplifier 416 is connected to the output of the same so that the operational amplifier 416 operates as a buffer amplifier (impedance converter).

The output of the operational amplifier 416 is connected to the non-inverting input terminal of the comparator 15 as well as an inverting input terminal of an operational amplifier 421. The output of the operational amplifier 421 is connected to a non-inverting input terminal of an operational amplifier 427 via a diode 422, with inverting input terminals of the amplifiers 421, 427 both connected to the output of the amplifier 427. Therefore, these operational amplifiers form a buffer amplifier.

The non-inverting input terminal of the operational amplifier 427 is grounded via a resistance 423 and a capacitor 426, the junction therebetween being connected to a collector of a transistor 425 via a resistance 424. The transistor 425 has its emitter grounded and its base supplied with a resetting signal from the CPU 11. The resetting signal goes high when resetting is to be made.

The output of the operational amplifier 427 is grounded via resistances 431 and 432 forming the comparative level-setting circuit 14, the junction between the resistances 431, 432 being connected to the inverting input terminal of the comparator 15.

The circuit of FIG. 2 operates as follows: A peak value of the detected sparking voltage V (output from the operational amplifier 416) is held by the peak-holding circuit 13, the held peak value is multiplied by a predetermined value smaller than 1 by the comparative level-setting circuit 14, and the resulting product is applied to the comparator 15 as the comparative level VCOMP. Thus, a pulse signal indicative of the comparison result, which goes high when V>VCOMP stands, is output from the comparator 15 through a terminal T4.

The operation of the misfire-detecting system constructed as above according to this embodiment will now be explained with reference to a timing chart formed of FIG. 3*a* to FIG. 3*e*. In FIG. 3*b* to FIG. 3*e*, the solid lines show operation at normal firing, while the broken lines show operation at a misfire attributable to the fuel supply system (hereinafter referred to as "FI misfire").

FIG. 3*a* shows the ignition command signal A, and FIG. 3*b* show changes in the detected sparking voltage (output voltage from the first output circuit 12) V (B, B') and the comparative level (C, C') with the lapse of time. First, a sparking voltage characteristic obtainable in the case of normal firing will be explained with reference to these figures, which is indicated by the solid line.

Immediately after a time point t0 the ignition command signal A is generated, sparking voltage V rises to such a level as to cause dielectric breakdown of the mixture between the electrodes of the spark plug, i.e. across the discharging gap of the spark plug. After occurrence of the dielectric breakdown, the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge (late stage capacitive discharge) occurs. In this capacitive discharge state, the voltage between the spark plug electrodes again rises, i.e. in the direction of causing dielectric breakdown of the mixture. However, since the ignition coil 1 then has a small amount of residual energy, the amount of rise of the voltage is small. This is because the electrical resistance of the discharging gap is low due to ionizing of the mixture during firing.

In this connection, at normal firing, the charge stored in the floating capacitance between the diode 7 and the spark plug (i.e. residual charge left after the discharge) is not discharged toward the ignition coil 1 due to the presence of the diode 7, but neutralized by ions present in the vicinity of the electrodes of the spark plug 5, so that the sparking voltage V promptly declines after the termination of the capacitive discharge as if the diode 7 were not provided.

Next, a sparking voltage characteristic, indicated by the broken line, will be described, which is obtained when a FI misfire occurs, i.e. no firing occurs, due to supply of a lean mixture to the engine or cutting-off of the fuel supply to the engine caused by faulty operation of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture.

Thereafter, the discharge state shifts to an inductive discharge state, as in the case of normal firing. However, the electrical resistance of the discharging gap of the plug at the discharge is greater in the case of supply of a lean mixture, etc. than that in the case of normal firing so that the inductive discharge state tends to shift to a capacitive discharge state earlier than in the case of normal firing. The capacitive discharge occurring after termination of the inductive discharge (late-stage capacitive discharge) is much higher than that at normal firing, because the voltage of dielectric breakdown of the mixture is higher than that at normal firing.

On this occasion, almost no ion is present in the vicinity of the electrodes of the spark plug 5 so that the charge stored between the diode 7 and the spark plug 5 is not neutralized, nor is it allowed to flow backward to the ignition coil 1 due to the presence of the diode 7. Therefore, the charge is held as it is without being discharged through the electrodes of the spark plug 5. Then, when the pressure within the engine cylinder lowers so that the voltage between the electrodes of the spark plug 5 required for discharge to occur becomes equal to the voltage applied by the charge, there occurs a discharge between the electrodes of the spark plug 5 (at or about a time point t5). Thus, by virtue of the action of the diode 7, even after the termination of the capacitive discharge, the sparking voltage V is maintained in a high voltage state over a longer time period than at normal firing.

The curves C, C' in FIG. 3*b* show changes in the comparative level VCOMP with the lapse of time, obtained from the held peak value of the sparking voltage V. The peak-holding circuit 13 is reset at a time point t2 by a resetting signal supplied thereto to hold the comparative level VCOMP supplied to the comparator circuit 15 at a predetermined low level (>0 volts) until a time point t3, whereupon the reset state is canceled. Therefore, the comparative level VCOMP before the time point t2 shows a value dependent on the peak value reached after the peak-holding circuit 13 was reset on the last occasion. FIG. 3*c* shows outputs from the comparator 15. As is clear from FIG. 3*b* and FIG. 3*c*, at normal firing, V>VCOMP holds between time points t2 and t4, during which the output put from the comparator 15 has a high level.

On the other hand, at a misfire, V>VCOMP holds between time points t1 and t5, during which the output from the comparator 15 has a high level.

Therefore, it is possible to determine occurrence of a misfire by measuring the pulse duration of the pulse signal indicative of the comparison result output from the comparator 15, and comparing the pulse duration with a reference value.

FIG. 4 shows a program for determining occurrence of a misfire based on the comparison result pulse, which is executed by the CPU 11 at predetermined fixed intervals.

First, at a step S1, it is determined whether or not a flag IG, which is set to "1" when the ignition command signal is generated (at the time point t0), is equal to "1".

If the answer to this question is negative (NO), i.e. if the flag IG is equal to 0, a measured time value tR of a resetting timer is set to 0 at a step S2, followed by terminating the program. If the answer to the question of the step S1 is affirmative (YES), i.e. if the flag IG is equal to 1, it is determined at a step S3 whether or not the value tR of the resetting timer is smaller than a predetermined value tRESET. Immediately after the flag IG has been changed from 0 to 1, the answer to this question is affirmative (YES), and then at a step S6, it is determined whether or not the comparison result pulse from the comparator 15 assumes a high level. If the answer to this question is negative (NO), the program is immediately terminated, whereas if it is affirmative (YES), a count value CP of a counter, not shown, for measuring the pulse duration of the comparison result pulse is increased by an increment of 1 at a step S7, and then it is determined at a step S8 whether or not the resulting count value CP is smaller than a reference value CPREF.

If the answer to the question of the step S8 is affirmative (YES), i.e. if CP<CPREF, it is determined that a normal firing has occurred, and a flag FMIS is set to 0 at a step S9, whereas if the answer is negative (NO), i.e. if CP≧CPREF, it is determined that an FI misfire has occurred, and the flag FMIS is set to 1 at a step S10, followed by terminating the program.

If the answer to the question of the step S3 becomes negative (NO), i.e. tR>tRESET, the count value CP and the flag IG are both reset to 0 at respective steps S4 and S5, followed by the program proceeding to the step S9.

According to the FIG. 4 program described above, as shown in FIG. 3*d* and FIG. 3*e*, the count value CP does not exceed the reference value CPREF at normal firing, whereas the former exceeds the latter at a misfire, e.g. at the time point t6 in the illustrated example, whereupon a misfire is determined to have occurred, and then the flag FMIS is changed from 0 to 1.

In addition, the count value CP may be obtained by a counter which counts the number of clock pulses generated at a predetermined frequency while the comparison result pulse is at a high level.

FIG. 5 shows a program for determining whether the misfire-detecting system is abnormal, which is executed by the misfire-detecting system according to the first embodiment described above, at predetermined timing whenever ignition of each cylinder is carried out, i.e. when a final value of the count value CP is obtained upon completion of execution of the FIG. 4 program for each ignition of each cylinder of the engine.

First, at a step S21, it is determined whether or not the engine is idling. This determination is made by determining whether or not the engine rotational speed, and the intake pipe absolute pressure or the throttle valve opening fall within respective predetermined ranges. Alternatively of or in combination with this manner of determination, whether or not the engine is idling may be determined by determining whether the engine rotational speed falls within a predetermined range and at the same time a transmission, not shown, of a vehicle in which the engine is installed is in a neutral position, which transmits output torque from the engine to driving wheels. In other words, this determination at the step S21 is provided for permitting the abnormality diagnosis on when the engine is in self-sustaining operation free of the influence of driving torque by a starting motor or the inertia of the vehicle.

If the answer to the question of the step S21 is negative (NO), i.e. if the engine is not idling (in self-sustaining operation), a count value FSMFS is set to a value of 0 at a step S23, immediately followed by terminating the program.

If the answer to the question of the step S21 is affirmative (YES), i.e. if the engine is idling (in self-sustaining operation), it is determined at a step S22 whether or not the count value CP representative of the pulse duration of the comparison result pulse which has been finally obtained by the FIG. 4 program is smaller than a predetermined lower limit value FSMFS. The predetermined lower limit value FSMFS is set to a value smaller than the minimum possible value of the count value CP at normal firing, i.e. such a small value as will in no way be assumed by the count value CP if the sparking voltage sensor 10, the connection line 10*a*, and other component parts associated therewith (hereinafter referred to as "the sensor system") are normally functioning.

This determination at the step S22 is based on the following concept: The peak-holding circuit 13 is supplied with the resetting signal during a time period t2 to t3 in FIG. 3*b* to hold the comparative level VCOMP at the predetermined low level. Therefore, if the sparking voltage sensor 10 provides no output therefrom, or if the detected sparking voltage V always assumes 0 volts due to a disconnection or a ground fault in the connection line 10*a*, etc., the output from the comparator 15 is held at the low level (i.e. V<VCOMP holds). In short, in the event of occurrence of such an abnormality in the misfire-detecting system, no comparison result pulse is supplied to the CPU 11, and hence the count value continues to assume a value of 0, and hence CP<FSMFS holds.

If the answer to the question of the step S22 is negative (NO), i.e. if CP≧FSMFS, the program proceeds to the step S23, whereas if it is affirmative (YES), i.e. if CP<FSMFS, the program proceeds to a step S24, where the count value nFSMS is increased by an increment of 1. Then, at a step S25, it is determined whether or not the count value nFSMS is equal to a predetermined reference value nFSMFS (e.g. 4 in the case of a four-cylinder engine) for determining the time duration of a low level-held state of the output from the comparator 15. If the answer to this question is negative (NO), the program is immediately terminated, whereas if it is affirmative (YES), it is determined that an abnormality has occurred in the sensor system, and a flag FFSMFS indicative of detection of the sensor abnormality is set to a value of 1 at a step S26, followed by terminating the program.

According to the program described above with reference to FIG. 5, under the condition of idling (self-sustaining operation) of the engine, if the count value CP continues to be smaller than the predetermined lower limit value FSMFS over a predetermined time period corresponding to the predetermined reference value nFSMFS0, it is determined that the sensor system is abnormal, since as described above, if the sensor system is normally functioning during self-sustaining operation of the engine, there occurs a time period over which the sparking voltage V exceeds the comparative level VCOMP (t2 to t4 in FIG. 3*b* and FIG. 3*c*). This makes it possible to detect a fault in the sparking voltage sensor 10, a disconnection or a ground fault in the connection line 10*a*, etc.

FIG. 6 shows the circuit arrangement of a misfire-detecting system according to a second embodiment of the invention. This embodiment is distinguished from the FIG. 1 arrangement in that a second comparator 23 is additionally provided, which has an inverting input terminal thereof connected to the CPU 11, a non-inverting input terminal thereof connected to the output of the first input circuit 12, and its output connected to the CPU 11. The inverting input terminal of the second comparator 23 is supplied from the CPU 11 with a predetermined voltage having a level equal to the predetermined low level at which is held the comparative level VCOMP supplied from the comparative level-setting circuit 14 to the comparator 15 when the peak-holding circuit 13 is reset. When the output V from the first input circuit 12 exceeds the predetermined voltage, the second comparator 23 outputs a comparison result pulse for self-diagnosis of the misfire-detecting system.

In this embodiment, while the misfire-detection is carried out by the use of the output from the comparator 15 in the manner as in the first embodiment described before, the determination of abnormality of the sensor system is carried out by the use of the output from the second comparator 23 in the same manner as in the FIG. 5 program described before.

FIG. 7 shows the circuit arrangement of a misfire detecting system according to a third embodiment of the invention. In this embodiment, the ECU 8 is comprised of a voltage-detecting section 8*a* and a misfire-determining section 8*b*, the two section being physically separated from each other. The modified arrangement of the ECU 8 takes into consideration the fact that leakage current from component parts of the voltage-detecting section 8*a* due to deteriorated insulation thereof may undesirably cause application of high leak voltage to the other component parts of the ECU 8, and therefore it intends to prevent the application of the leak voltage from adversely affecting the CPU 11 and other control circuits, not shown. Further, the FIG. 7 arrangement intends to prevent high frequency noise resulting from sparking discharge at the spark plugs from adversely affecting the CPU 11 and the other control circuits.

In the figure, the output of the comparator 15 is connected via a resistance 18 to a base of a transistor 19 which has its emitter connected to the supply voltage-feeding line VBS and its collector connected via a resistance 20 and a connection line 8*c* to a base of a transistor 21 provided in the misfire-detecting section 8*b*. The transistor 21 has its emitter grounded and its collector connected to the CPU 11 and also to the supply voltage-feeding line VBS via a resistance 22. Further, a connection line 8*d* connects between the resetting input terminal of the peak-holding circuit 13 and the CPU 11. The rest of the misfire detecting system according to the third embodiment is identical in construction to the first embodiment described hereinabove with reference to FIG. 1.

According to the FIG. 7 arrangement, as the output from the comparator 15 goes high or low, the potential at the collector of the transistor 21 goes high or low accordingly, so that the CPU 11 is supplied with the same comparison result pulse as that in the first embodiment. Further, when a disconnection or a ground fault occurs in the connection line 8*c*, the collector of the transistor 21 is held at a high level.

FIG. 8 shows a program for determining whether or not the connection line 8*c* is faulty, by detecting a high level-held state of the collector of the transistor 21, which is executed, at predetermined timing for each ignition of each cylinder, by the misfire-detecting system according to the third embodiment.

First, at a step S31, the same determination as the step S21 in FIG. 5 described hereinabove is carried out. If the answer to the question of this step is negative (NO), i.e. if the engine is not idling (not in self-sustaining operation), a count value nMF of a counter, not shown, is set to a value of 0 at a step S33, followed by terminating the program. If the answer to the question of the step S31 is affirmative (YES), i.e. if the engine is idling (in self-sustaining operation), it is determined at a step S32 whether or not the count value CP is larger than a predetermined upper limit value FSSENS.

The predetermined upper limit value FSSENS is set to a value much higher than the reference value CPREF for determining a misfire, i.e. such a large value as will in no way be assumed by the count value CP if the connection line 8*c* is normally functioning.

If the answer to the question of the step S32 is negative (NO), i.e. if $CP \leqq FSSENS$, the program proceeds to the step S33, whereas if it is affirmative (YES), i.e. if $CP > FSSENS$, the count value nMF is increased by an increment of 1 at a step S34, and then it is determined at a step S35 whether or not the count value nMF is equal to a predetermined reference value nMF0 (e.g. 4 in the case of a four-cylinder engine) for determining the high level-held state of the collector of the transistor 21. If the answer to this question is negative (NO), the program is immediately terminated, whereas if it is affirmative (YES), it is determined that the connection line 8*c* is suffering from a disconnection or a ground fault, and a flag FSMFS indicative of detection of abnormality of the connection line 8*c* is set to a value of 1 at a step S36, followed by terminating the program.

According to the program described above with reference to FIG. 8, under the condition of idling (self-sustaining operation) of the engine, if the count value CP continues to be larger than the predetermined upper limit value FSSENS over a predetermined time period corresponding to the predetermined reference value nMF0, it is determined that the connection line 8*c* is abnormal, since normally, the count value CP cannot continuously exceed the upper limit value FSSENS. This makes it possible to detect an electrical disconnection or a ground fault in the connection line 8*c* connecting between the voltage-detecting section 8*a* and the misfire-determining section 8*b*.

In addition, the misfire-detecting system according to this embodiment can also detect abnormality of the sensor system by the use of the FIG. 5 program.

What is claimed is:

1. In a misfire-detecting system for an internal combustion engine having at least one cylinder, and a spark plug provided in each of said at least one cylinder, said system including engine operating condition-detecting means for detecting values of operating parameters of said engine, signal-generating means for determining ignition timing of said engine, based upon values of operating parameters of said engine detected by said engine operating condition-detecting means for generating an ignition command signal indicative of the determined ignition timing, igniting means responsive to said ignition command signal for generating high voltage for causing generation of sparking voltage across said spark plug for discharging said spark plug, voltage value-detecting means for detecting a value of said sparking voltage generated across said spark plug when said high voltage is generated by said igniting means, comparing means for comparing the detected value of said sparking voltage with a first predetermined reference voltage value, measuring means for measuring a time period over which the detected value of said sparking voltage exceeds said first predetermined reference voltage value, and misfire-determining means for determining that a misfire has occurred in said engine when the measured time period exceeds a predetermined time period value, the improvement comprising:

engine operating condition-determining means for determining whether said engine is in a self-sustaining operation; and abnormality-determining means for comparing said detected value of said sparking voltage with a second predetermined reference voltage value and for determining whether said misfire-detecting system is abnormal based upon a result of the comparison when said engine operating condition-determining means determines that said engine is in said self-sustaining operation.

2. A misfire-detecting system according to claim 1, wherein said abnormality-determining means determines that said misfire-detecting system is abnormal when the detected value of said sparking voltage is lower than said second predetermined reference voltage value while said engine is determined to be in said self-sustaining operation.

3. A misfire-detecting system according to claim 2, wherein said second predetermined reference voltage value is set to a value lower than said first predetermined reference voltage value.

4. A misfire-detecting system according to claim 3, wherein said abnormality-determining means finally determines that said misfire-detecting system is abnormal when said misfire-detecting system is continuously determined to be abnormal over a predetermined time period.

5. A misfire-detecting system according to any of claims 2–4, including a connection line connecting between said voltage-detecting means and said comparing means, and wherein said abnormality-determining means determines abnormality in said voltage-detecting means and said connection line.

6. A misfire-detecting system according to claim 1, including second comparing means for comparing said detected value of said sparking voltage with a third predetermined reference voltage value, and wherein said abnormality-determining means determines that said misfire-detecting system is abnormal when the detected value of said sparking voltage is determined to have continued to be higher than said third predetermined reference voltage value over a predetermined time period while said engine is determined to be in said self-sustaining operation.

7. A misfire-detecting system according to claim 6, including a voltage-detecting section for detecting said sparking voltage, a misfire-determining section for determining whether a misfire has occurred in said engine, based upon the detected sparking voltage, and a connection line connecting between said voltage-detecting section and said misfire-determining section, and wherein said abnormality-determining means determines abnormality in said connection line.

8. A misfire-detecting system according to any of claims 1–4, 6 and 7, wherein said engine includes a transmission for transmitting torque from said engine, said engine operating condition-determining means determining that said engine is in said self-sustaining operation, when at least one of a condition that said engine is rotating and at the same time said transmission is in a neutral position, and a condition that said engine is idling, is satisfied.

9. A misfire-detecting system according to claim 5, wherein said engine includes a transmission for transmitting torque from said engine, said engine operating condition-determining means determining that said engine is in said self-sustaining operation, when at least one of a condition that said engine is rotating and at the same time said transmission is in a neutral position, and a condition that said engine is idling, is satisfied.

10. In a misfire-detecting system for an internal combustion engine having at least one cylinder, and a spark plug provided in each of said at least one cylinder, said system including engine operating condition-detecting means for detecting values of operating parameters of said engine, signal-generating means for determining ignition timing of said engine, based upon values of operating parameters of said engine detected by said engine operating condition-detecting means and for generating an ignition command signal indicative of the determined ignition timing, igniting means responsive to said ignition command signal for generating high voltage for causing generation of sparking voltage across said spark plug for discharging said spark plug, and voltage value-detecting means for detecting a value of said sparking voltage generated across said spark plug when said high voltage is generated by said igniting means, the improvement comprising:

engine operating condition-determining means for determining whether said engine is in a self-sustaining operation; and abnormality-determining means for comparing said detected value of said sparking voltage with a predetermined reference voltage value and for determining whether said misfire-detecting system is abnormal based upon a result of the comparison when said engine operating condition-determining means determines that said engine is in said self-sustaining operation.

11. A misfire-detecting system according to claim 10, wherein said engine includes a transmission for transmitting torque from said engine, said engine operating condition-determining means determining that said engine is in said self-sustaining operation, when at least one of a condition that said engine is rotating and at the same time said transmission is in a neutral position, and a condition that said engine is idling, is satisfied.

12. In a misfire-detecting system for an internal combustion engine having at least one cylinder, and a spark plug provided in each of said at least one cylinder, the improvement comprising:

engine operating condition-determining means for determining whether said engine is in a self-sustaining operation; and abnormality-determining means for determining said misfire-detecting system is abnormal when said misfire-detecting system detects a misfire and said engine operating condition-determining means determines that said engine is in said self-sustaining operation.

* * * * *